US005096432A

United States Patent [19]

Cullen et al.

[11] Patent Number: 5,096,432

[45] Date of Patent: Mar. 17, 1992

[54] ELECTRIC POWER SOCKET

[76] Inventors: John P. Cullen, 29 Amaroo Street; Bruce S. Baynes, 35 Kennedy Avenue, both of Wagga Wagga, New South Wales, 2650, Australia

[21] Appl. No.: 299,919

[22] PCT Filed: Jun. 19, 1987

[86] PCT No.: PCT/AU87/00178

§ 371 Date: Feb. 21, 1989

§ 102(e) Date: Feb. 21, 1989

[87] PCT Pub. No.: WO87/07983

PCT Pub. Date: Dec. 30, 1987

[30] Foreign Application Priority Data

Jun. 20, 1986 [AU] Australia ..... PH6495/86

[51] Int. Cl.[5] ..... H01R 13/453; H01R 13/447

[52] U.S. Cl. ..... 439/139; 439/137

[58] Field of Search ..... 439/137-139, 439/142

[56] References Cited

U.S. PATENT DOCUMENTS

| | | | |
|---|---|---|---|
| 3,668,607 | 6/1972 | Farnworth | 439/139 |
| 3,930,704 | 1/1976 | Dekanic | 339/42 |
| 4,707,042 | 11/1987 | Haden | 439/137 |

FOREIGN PATENT DOCUMENTS

| | | | |
|---|---|---|---|
| 140369 | 3/1951 | Australia . | |
| 37635/85 | 1/1985 | Australia . | |
| 2109720 | 10/1971 | Fed. Rep. of Germany | 439/139 |
| 2745122 | 4/1979 | Fed. Rep. of Germany . | |
| 7416555 | 12/1975 | France . | |
| 468091 | 10/1969 | Switzerland . | |
| 1198670 | 7/1970 | United Kingdom . | |
| 1490571 | 11/1977 | United Kingdom . | |
| 2038112 | 7/1980 | United Kingdom . | |

*Primary Examiner*—Paula A. Bradley

*Attorney, Agent, or Firm*—Sughrue, Mion, Zinn Macpeak & Seas

[57] ABSTRACT

Electric power socket (10) having structure (12) supporting electric contacts (20, 22, 24). A plug receptacle (18) having openings (100, 90) (102, 92) and (104, 94) therethrough is positioned for rotation in front of the contacts (20, 22, 24). The plug receptacle (18) is normally locked at an inactive position, at which it covers the contacts (20,22 24), by means of resiliently depressable locking tongues (142) which engage openings (90,94) of the plug receptacle. When pins of an electric plug are pressed into the plug receptacle (18) to pass through the openings (104,94) and (100,90) the pins engage the tongues (142), depressing them to allow the plug and plug receptacle to be rotated to align the plug pins with the contacts (20,22,24). Subsequent inward movement of the plug engages the pins with the contacts (20,22,24). The receptacle (18) has a front pin guard (28) which is forwardly resiliently biased against the plug body to cover the plug pins, this being depressed inwardly during the movement of the plug to engage contacts (20,22,24).

5 Claims, 7 Drawing Sheets

ELECTRIC POWER SOCKET

This invention relates to an electric power socket. The invention is particularly concerned with the safety of electric power sockets. As a matter of convenience the invention will be hereinafter described with reference to three pin sockets of the kind used in domestic AC power circuits in Australia, but the invention has other applications.

Three pin sockets are commonly used in domestic establishments and other circumstances such as to present a danger in the event of careless use. Various attempts have been made to improve the safety of such devices. Australian patent 249,576 for example discloses a socket having a rotatable for spring biased cover plate, and Australian patent 162,217 discloses an electrical socket and plug arrangement in which the socket has a rotatable switch and the plug has a rotatable switch actuator. Such constructions have not been entirely satisfactory for a number of reasons.

Embodiments of the invention are of relatively simple construction and arranged such that there is relatively decreased danger of an active or live contact of the socket being engaged by a foreign object inserted into a contact pin opening of the socket. Embodiments of the invention are arranged to at least substantially guard the contact pins of a co-operable plug against inadvertant engagement external of the socket.

According to the present invention there is provided an electric power outlet socket comprising a structure supporting electrical contacts for connection to pins of an electric plug when inserted into the socket and a plug receptacle mounted for movement between a first position at which the contacts are covered to prevent access thereto and a second position at which the contacts are uncovered to permit making said connections thereto, and locking means normally preventing movement of the receptacle to the second position but being engagable by the pins of said plug when inserted into the receptacle to permit release thereof for permitting movement to said second position, wherein the receptacle further includes a pin guard, said pin guard having pin receiving openings therein and arranged to enclose the pins during movement of the plug to effect engagement between the pins and said contacts, said pin guard being mounted for movement with the plug whereby to enclose said pin during said plug movement.

The foregoing concept can be embodied in sockets of various forms, but it will be convenient to describe the invention with particular reference to three-pin sockets. Furthermore, the example three-pin socket hereinafter described is not the only three-pin socket to which the invention is applicable.

The invention is further described by way of example only with reference to the accompanying drawings in which.

Figure 1:
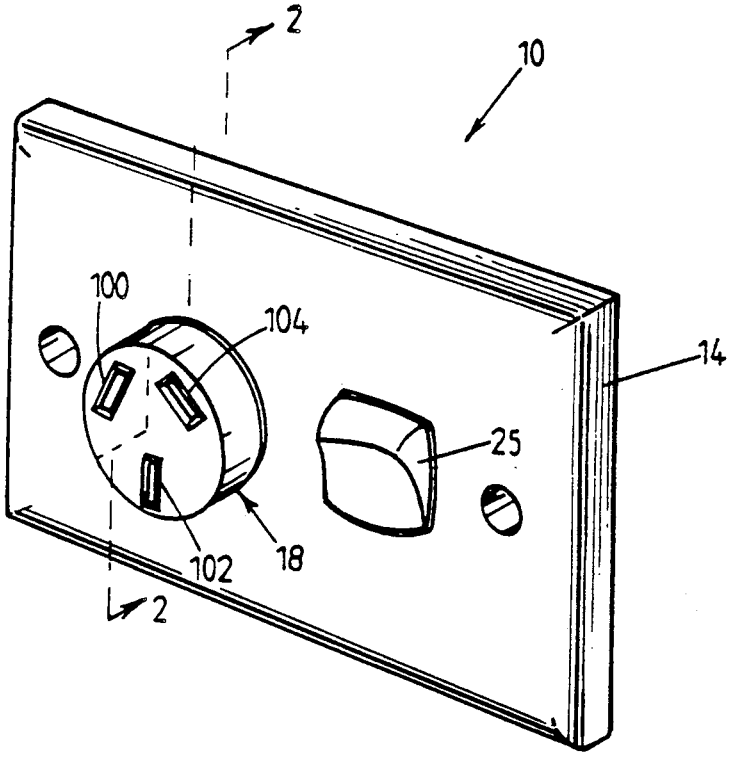
FIG. 1 is a perspective view of an electric socket constructed in accordance with the invention.
Figure 2:
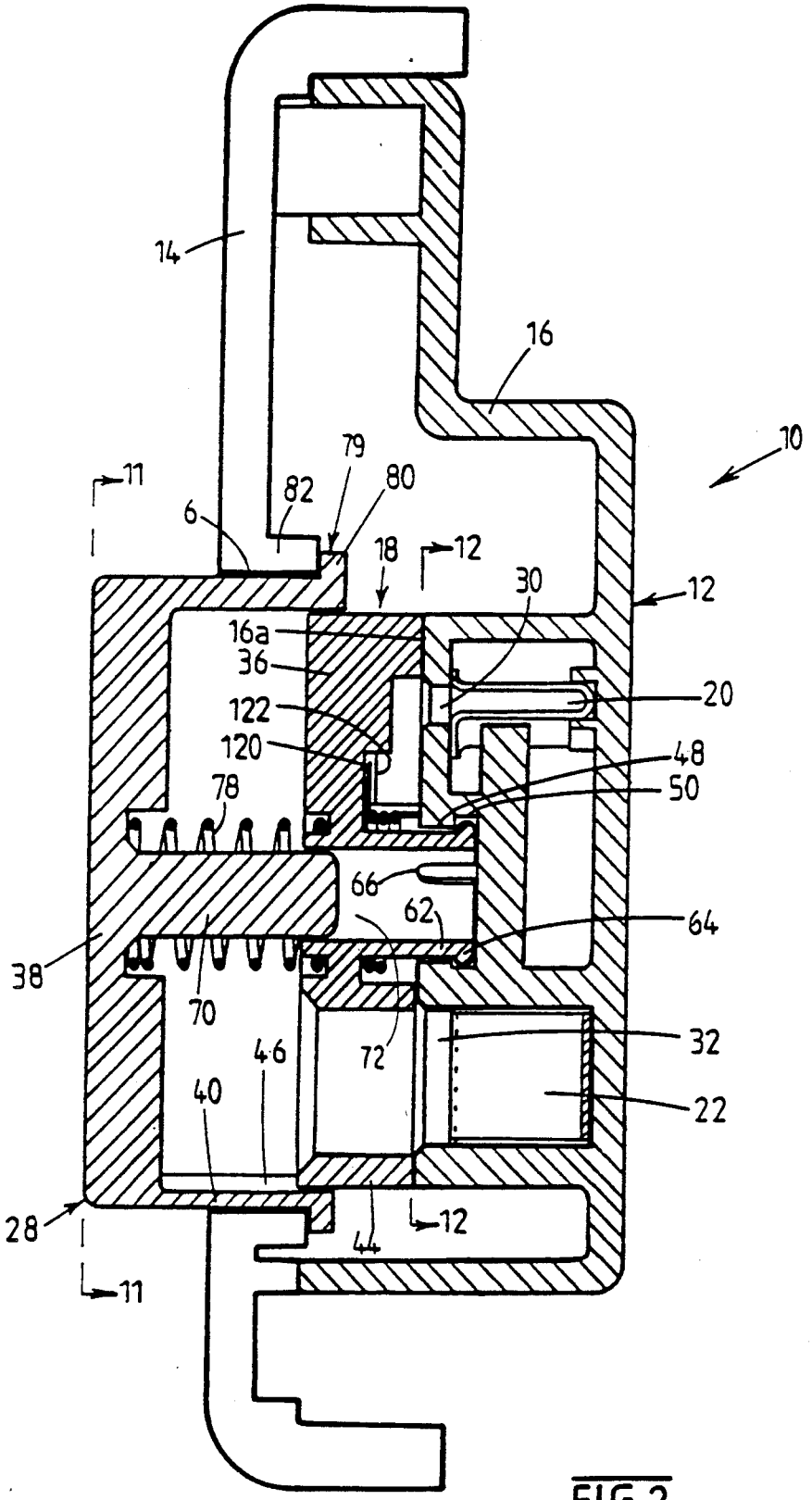
FIG. 2 is a cross-section substantially on the line 2—2 in FIG. 1.
Figure 10:
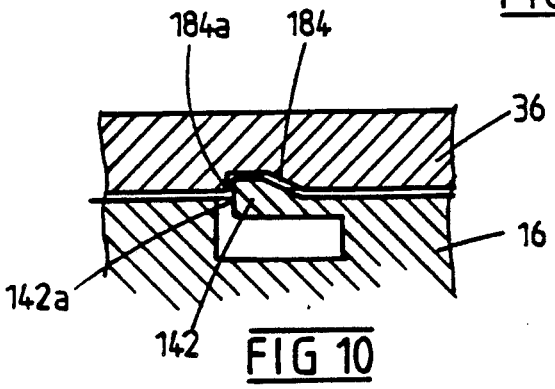
Figure 11:
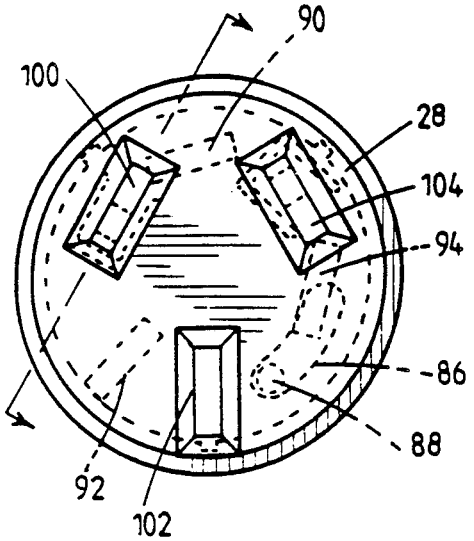
Figure 13:
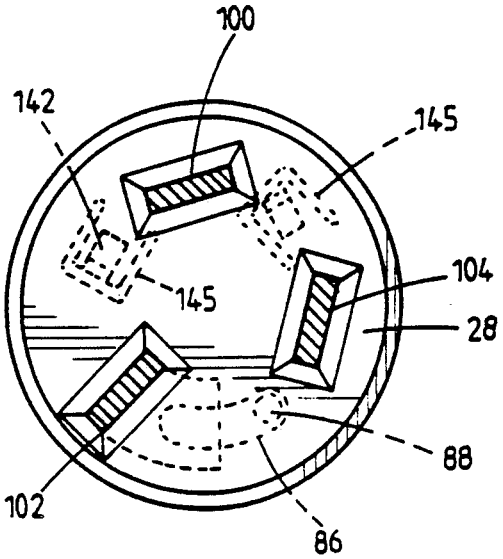
Figure 12:
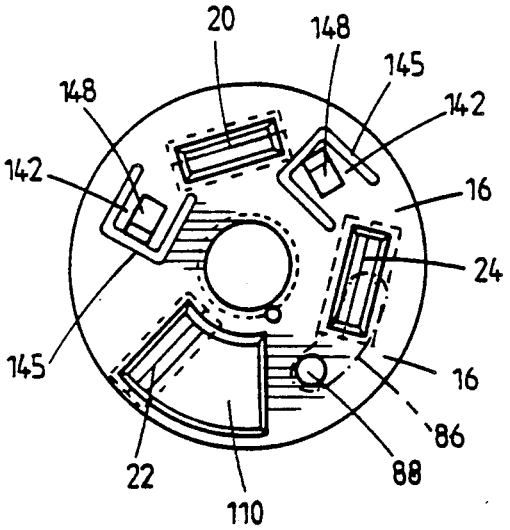
Figure 14:
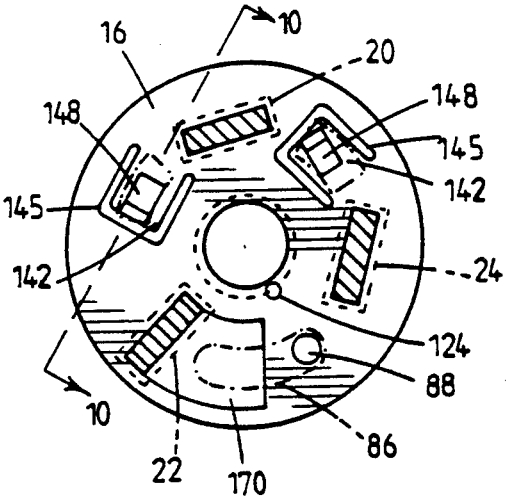
Figure 15:
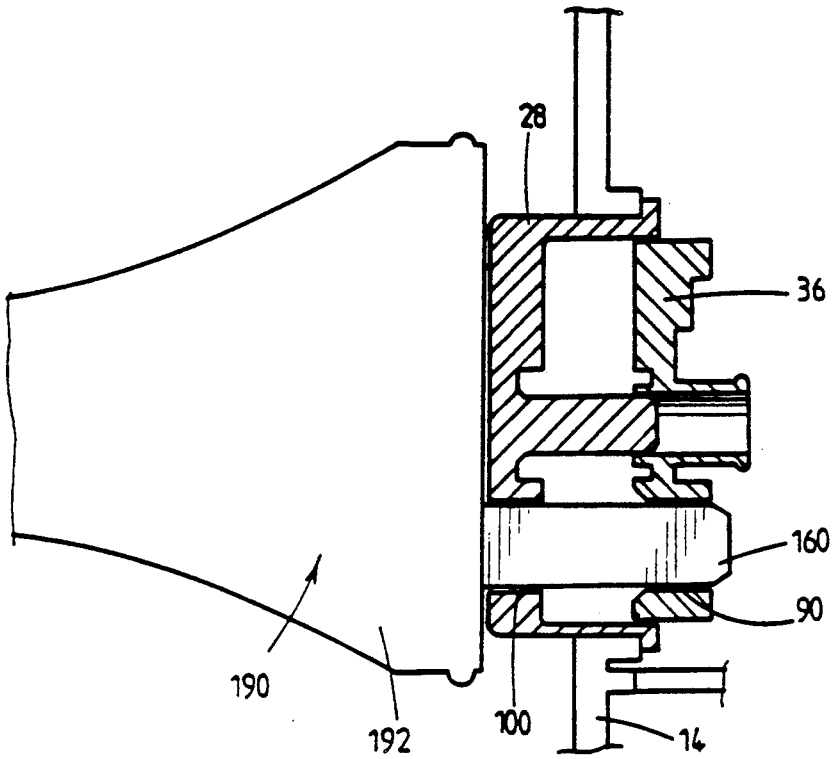
Figure 16:
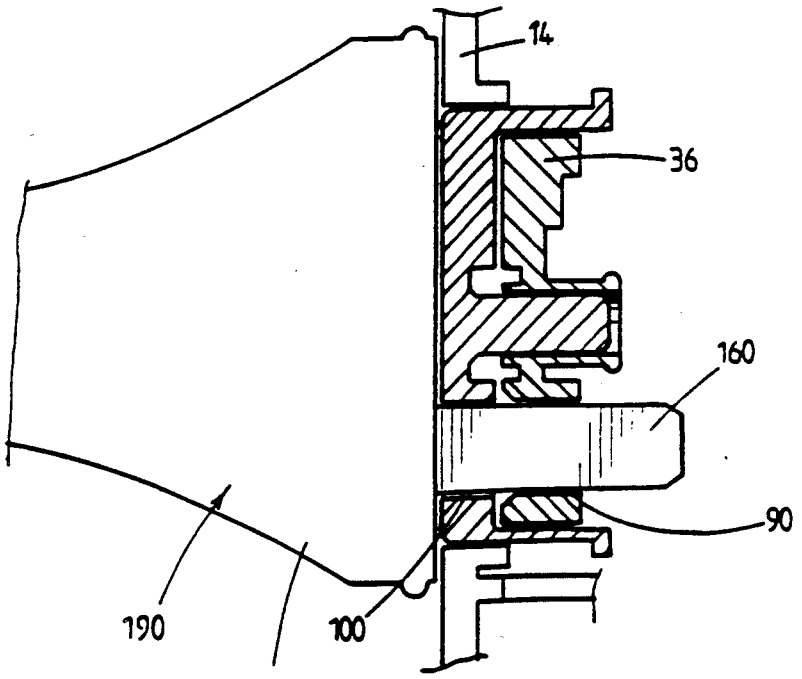

FIGS. 6 to 9 inclusive are enlarged cross-sectional diagrams illustrating the manner of unlatching of coupling between a backing plate and contact guard incorporated into the socket of FIG. 1;

FIG. 10 is a fragmentary side view showing the position of a locking means included in the socket of FIG. 1 under a condition where the socket is in use;

FIGS. 11 and 12 are views, respectively, on the lines 11—11 and 12—12 in FIG. 2, under a condition where the socket is not in use;

FIGS. 13 and 14 are respectively views on the lines 11—11 and 12—12 in FIG. 2 but showing the socket in a condition where it is in use;

FIGS. 15 and 16 are axial cross-sections of portion of the socket of FIG. 1, showing the locations of certain component parts when a plug is inserted into the socket.

The socket 10 shown in the drawings includes a mounting structure 12, in this case of two part construction having a front mounting plate 14 and a rearwardly positioned backing plate 16, these being secured together by a means such as screws (not shown).

The backing plate 16 carries three electrical contacts 20, 22 and 24 arranged in the array best appreciated from FIG. 12, which array corresponds to an Australian standard contact layout prescribed by domestic electricity supply authorities. The contact 22 is an "earth" contact whilst the contacts 20 and 24 are, respectively, "neutral" AC supply and "active" AC supply contacts. The contacts may be of any suitable form to accept the rectangular cross-sectioned pins of a mating plug.

The plate 14 carries, on its front, a switch 25 which controls electric supply from exterior contacts (not shown) on the backing plate to the contacts 20, 22, 24.

The backing plate 16 has, on an internal surface **16*a* which faces forwards when the socket 10 is positioned for use, three rectangular sectioned openings 30, 32 and 34 which are positioned immediately in front of the contacts 20, 22 and 24 and serve to guide the pins of an electrical socket for entry into and for contact with the contacts 20, 22, 24. However, a generally cylindrical plug receptacle 18 is mounted for axial rotation in an opening 26 through plate 14 and is positioned so as, in an inactive condition of socket 10, to cover the openings 30, 32, 34 to prevent plug pins from passing through these openings and making contact with the contacts 30, 32, 34**.

The plug receptacle is of two part form having a generally cup shaped outer pin guard 28 and shallow cylindrical contact guard 36. Pin guard 28 has an outer transverse wall 38 and a rearwardly directed cylindrical tubular section 40. The pin guard is a sliding fit over the contact guard 36, but rotation of these components one relative to the other is precluded by engagement between lengthwise extending ribs 44 on the periphery of the contact guard 36 with lengthwise extending grooves 46 on the inner surface of the tubular section 40 of pin guard 28.

The contact guard 36 is mounted for axial rotation over the surface **16*a* of the backing plate 16. Thus, the backing plate 16 has a shallow cylindrical opening 48 therein, approximately centrally positioned relative to the locations of the openings 30, 32, 34 therein. Openings 48 is closed at its inner end and has an undercut periphial groove 50** in its side surface adjacent the closed end.

The contact guard 36 has a rearwardly extending cylindrical spigot 62 with an annular ridge 64 formed on the outer surface thereof at the free end of the spigot. A central opening 72 extends through contact guard 36 and axially through spigot 62. The spigot has a plurality of lengthwise extending slots 66 which extend from the free end of the spigot and through the side wall thereof, to permit some resilient inward compression of segments of the side wall defined between adjacent ones of the slots. Furthermore, the sizing of the ridge 64 is such that it can be neatly accommodated within the groove 50 by aligning spigot 62 coaxially with the axis of the opening 48 in backing plate 16 and then pressing the contact guard 36 and thus also the spigot towards the backing plate 16. Then, the spigot 62 enters the opening 48 and, by camming action against the side surface of the openings, inwardly deforms the wall segments at the free end of the spigot to allow the spigot to be passed into the opening until a point is reached where the ridge 64 is opposite the groove 50 whereupon the groove 50 is able to accommodate the ridge 64 by return of the spigot, under natural resilience, to its original condition. This return occurs by movement outwards the segments of the free end of the spigot. The diameter of the ridge 64 is arranged to be rather greater than the diameter of the opening 48 but rather less than the diameter of the groove 50. The diameter of the spigot 62 is arranged to be a free rotational fit in the opening 50. As a result once the contact guard 36 is assembled onto backing plate 16, the spigot 62 may rotate freely in the opening 48 but it, and the contact guard itself, is held against withdrawl from the openings 48 by engagement between the ridge 64 and the groove 50.

The pin guard 28 has an axially extending spigot 70 on its rear face, this being slidably accommodated within the central opening 72 through contact guard 36. The pin guard 28 is, however, biased outwardly relative to the contact guard by a helical compression spring 78 positioned over spigot 70 and bearing, at one end, against the rear face of the pin guard 28 and, at the other end, against the front face of the contact guard 36. Outward movement of the pin guard relative to the contact guard is limited by stop means 79, including an outwardly extending lip 80 at the rear end of the tubular section 40 of pin guard 28 and a rearwardly extending annular flange 82 formed on mounting plate 14 and around the opening 26.

By virtue of the rotatable coupling of the contact guard 36 to the backing plate 16, the receptacle 18 is rotatable about the axis thereof, but this rotation is limited to about 45° of rotation by engagement of opposite ends of an arcuate slot 86 in the rear face of the contact guard 36 with an upstanding spigot 88 on backing plate 16 adjacent the opening 32 therethrough.

Figure 3:
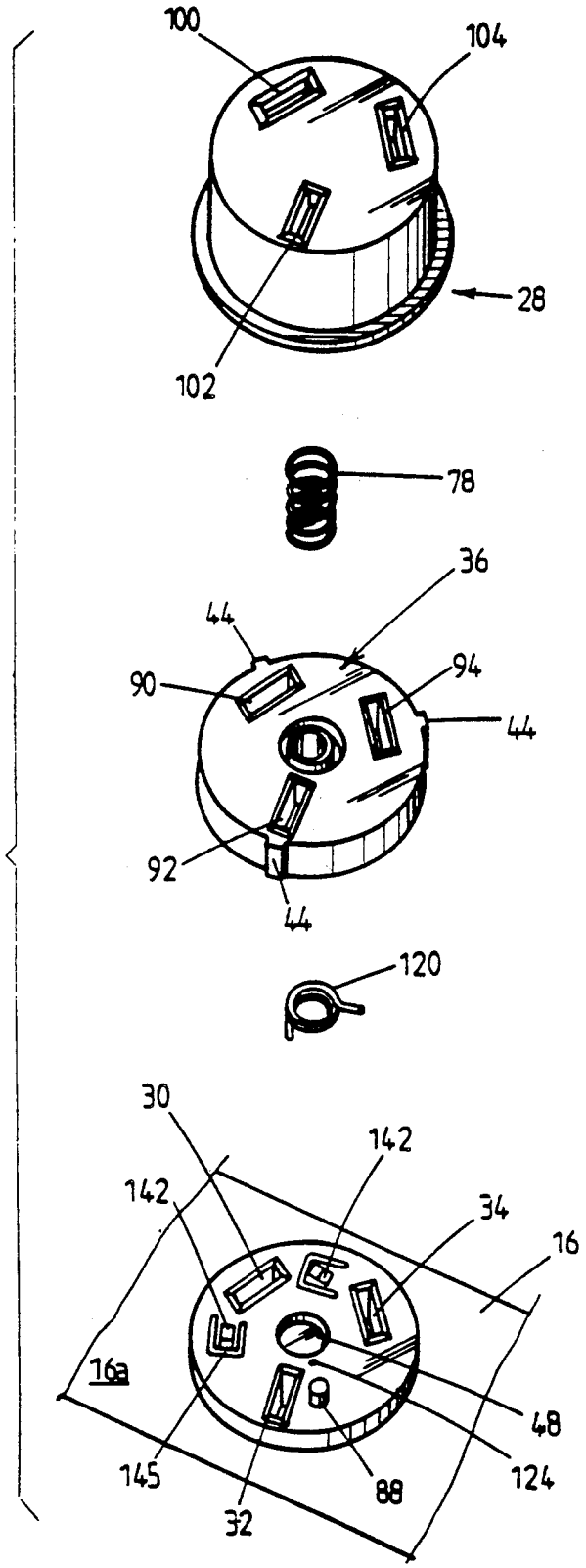
FIG. 3 is an exploded view of components of the socket of FIG. 1.

The pin guard 28 has, through wall 38, three openings 100, 102, 104 designed to neatly slidingly accommodate pins of an electrical socket and the contact guard 36 has three similar openings 90, 92, 94 therethrough, the opening 90 being aligned with the opening 100, the opening 92 being aligned with the opening 102 and the opening 94 being aligned with the opening 104. As mentioned previously, the contact guard 36 is, in an inactive condition of the socket 10, positioned so that the openings 30, 32, 34 in mounting plate 16 are covered, this corresponding to one extreme of rotational movement of receptacle 18. This condition is illustrated in FIG. 11 in which Figure is also noted the relative positions of the arcuate slot 86 and co-operating spigot 88 at that time. A helical torsion portion spring 120 is arranged to resiliently bias the contact guard 36 and receptacle 28 to this position. Spring 120 has one end thereof accommodated in a radial recess 122 in the back of contact guard 36 and the other end fixedly mounted relative to the backing plate 16, being neatly received in an opening 124 in the surface 16*a* thereof (FIG. 3).

Figure 6:
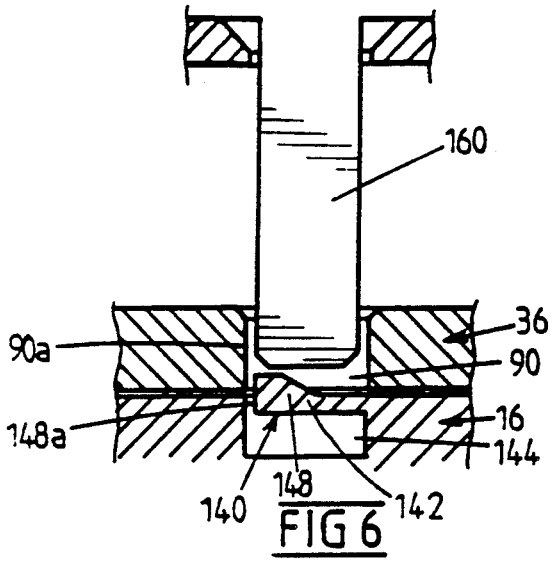
Figure 7:
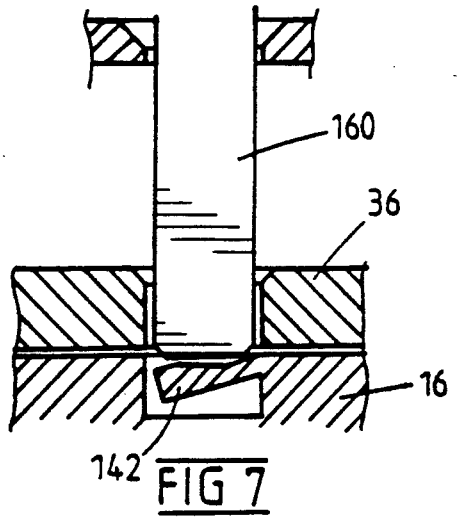
Figure 8:
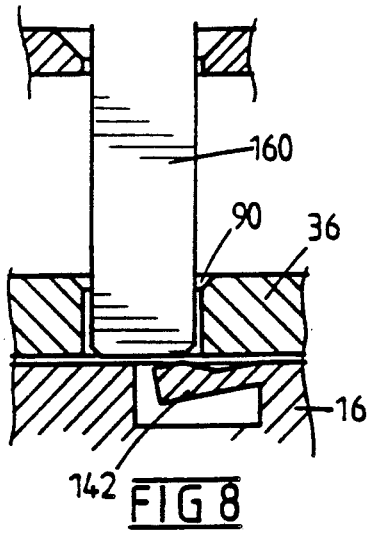

It is possible, under conditions described later, to rotate the receptacle 18 to provide an "active" socket condition so that the openings 90, 92, 94, and the also aligned openings 100, 102, 104 are brought into alignment with corresponding openings 30, 32, 34. In the inactive condition, of course, a plug may not be inserted into the socket in order to contact with the contacts 20, 22 and 24, in view of the openings 30, 32, 34 being covered. In the active condition, however, it is possible to slidingly pass the pins of the plug through the aligned openings 100, 90 and 30, 102, 92 and 32, and 104, 94 and 34 to make such connections. However, two releasable locking means 140 are provided normally preventing the necessary rotation of receptacle 18. There is a locking means 140 associated with each of openings 90, 94 in the contact guard 36. More particularly, as shown in FIG. 6 to 8, each such locking means includes a tongue 142 formed above an opening 144 in backing plate 16 by a generally U-shaped slot 145 through a thin section of the backing plate overlaying the opening 144. The tongues 142 have upstanding locking projections 148 and these have an upstanding abutment surfaces 148*a*. The abutments 148 project, in the inactive condition of the socket 10, into the openings 90, 94. It will be recalled that in this condition rotation of the contact guard 36 in one rotational direction (anti-clockwise as viewed in FIG. 1) is precluded by inter-engagement of the arcuate slot 86 and the co-operating pin 88. On the other hand, in this inactive condition, rotation is the opposite or clockwise direction is precluded by the projection of the abutments 148 into the openings 90, 94, and more particularly by engagement by the upstanding abutment surfaces 148*a* of each of these with respective side surfaces of each of the openings 90, 94. One such surface is shown in FIG. 6, designated by reference numeral 90*a*.

In order to free the releasable locking means 140 to permit rotation of receptacle 18 from the inactive position to the active position, it is necessary to depress the tongues 142 so that these are cleared below the rear surface of the contact guard 36. As illustrate in FIGS. 6 to 8, this action can be achieved by inserting pins of an electrical connector into the openings 100, 102, 104 to pass through the opening 90, 92, 94 in the receptacle 18 so that two of these pins bear upon the tongues 142 to clear these by downward depression from the openings 90, 94. This action is shown in FIGS. 6 to 8 in connection with the pin opening 90 and the tongue 142 immediately therebelow, reference numeral 160 denoting a plug pin so inserted.

There is no locking means associated with the opening 92 in the contact guard 36. Instead, when an electric plug is inserted into the receptacle 18 and moved so as to bring the pins thereof within the openings 90, 94 to bear against the underlying tongues 142, the third or earth pin of the contact is brought into engagement with the bottom surface of a shallow arcuate depression 170 in the surface 16*a* of backing plate 16. The earth pin is, in accordance with the afore mentioned Australian standard, of slightly greater length than the other two pins and the location of the bottom surface of the depression 170 which is engaged by the free end of the earth pin is positioned a sufficient distance below the outer surface of the backing plate 16 to limit inward movement of the plug to a condition at which the tongues 142 are just depressed to an extent sufficient to clear these from the openings 90, 94.

Figure 4:
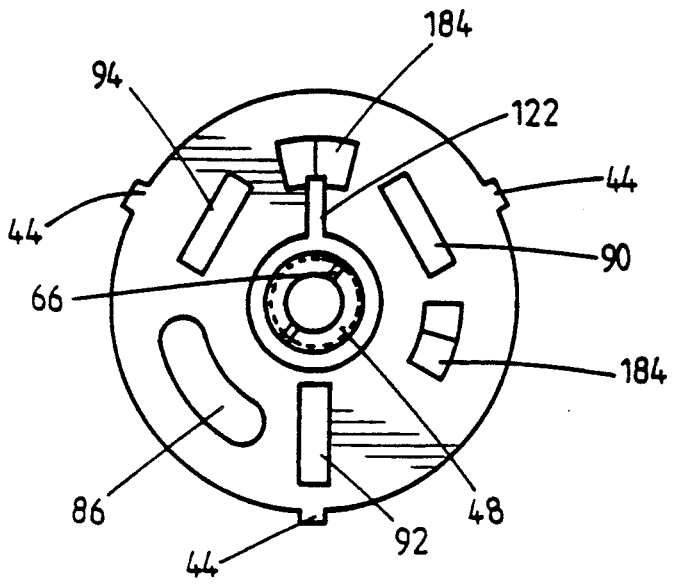
FIG. 4 is an underside view of a contact guard incorporated into the socket of FIG. 1.
Figure 5:
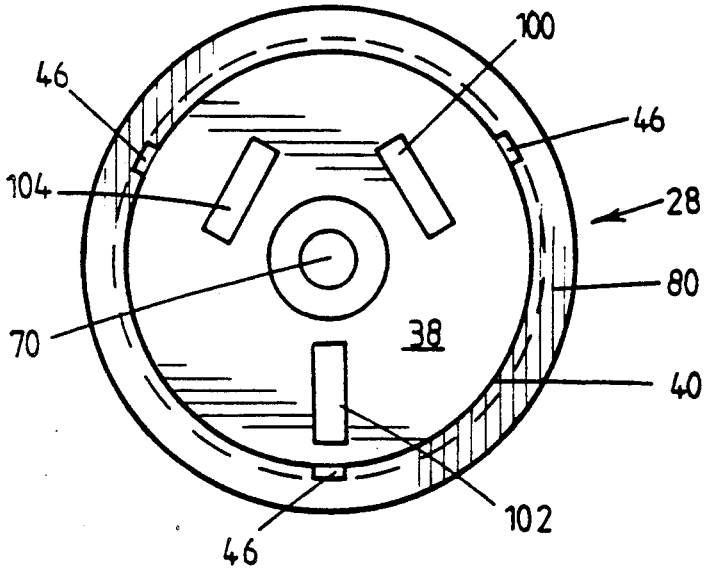
FIG. 5 is an underside of view of a pin guard incorporated into the socket of FIG. 1.

Under the condition of depression of the tongues 142, the inserted plug, as well as the receptacle 18, may be rotated in the clockwise direction as viewed in FIG. 1 through an angle of about 45° which is just sufficient to bring the openings in the backing plate and the receptacle 18 into alignment. This limit position may be established by engagement of the spigot 88 with an end of the arcuate opening 86. Alternatively, or additionally, positive identification of the rotational position at which the plug may be pressed freely into the openings 30, 32, 34 may be established by co-operation of the tongues 142 with appropriately positioned abutment surfaces formed on the underside of the contact guard 36. More particularly, as shown in FIG. 4, contact guard 36 is provided, in this instance, with two locating pockets 184. When viewed in a section such as that of FIG. 10, the pockets 184 have a configuration corresponding to the longitudinal section of the tongues 142. The pockets are made of complimentary form to the tongues so as to accommodate these therewithin when the receptacle 18 is moved to its activated position. The pockets 184 also have surfaces **184*a* which are then bought into engagement with the upstanding surfaces 148*a* on the abutments 148*a* of the tongues 142. In this way, the abutment of these pairs of surfaces serves, as described, to assist is locating the rotational position at which the plug pins may be passed into the openings 32, 30, 34. Furthermore, by making the pockets 184 of sufficient size, it is possible to so accommodate the tongues that these are under no resilient stress in the activated condition of the plug. It will be appreciated in that connection that as soon as the receptacle 18 rotated so that the openings 90, 94 are no longer aligned with the tongues, the tongues will resiliently bear against the underside of the contact guard 36** and, if the pockets where not present, the tongues would remain depressed in the activated condition of the socket, thus leaving them resiliently stressed, which may affect the resilience thereof if occurring for prolonged periods, such as where a plug was left inserted into the socket more or less permanently.

Figure 9:
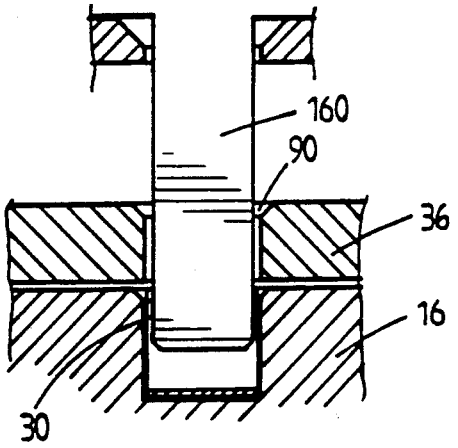

Under the condition where the pins of the socket pass through the openings 30, 32, 34, these make contact with the electrical contacts 20, 22, 24 therebehind and, under the condition of operation of the switch 24, can be connected to an electric supply to which the socket 10 is coupled. FIG. 9 shows a plug pin 160, for example, so entering the associated contact.

It will be recalled that the pin guard 28 is resiliently biased outwardly of the contact guard 36. This pin guard is, however, moved inwardly against that resilient bias, and moved towards the contact guard 36, as illustrated in FIGS. 15 and 16 during movement of a plug 190 inwardly of the socket. In that regard, the spacing of the front surface of the pin guard 28 relative to the contact guard 36 is made such that, as the pins of the plug are inserted through the openings in the pin guard, the pin guard is maintained resiliently biased to its outermost position until the condition is reached where the pins pass through the pin guard up to the point at which these project from the body 192 of the plug 190. This condition is reached before, or at least as, the longer "earth" pin of the plug reaches the bottom surface of the depression 170. Then, the pins of the plug, insofaras they project from the body 192, are totally enclosed in the socket 10, being covered, where these project forwardly of the plate 14, by the pin guard. This condition is maintained, with the pin guard resiliently biased against the body 192 of the plug 190, as the plug and receptacle 18 are rotated from the inactivated to the activated condition of the socket and, also, whilst the plug is subsequently moved axially to bring the plug pins into electrical contact with the contacts 20, 22, 24, the pin guard sliding rearwardly over the contact guard 36 against resilient bias of spring 78, which is then compressed. In the condition where electrical contact is made, the pin guard continues to be biased outwardly to enclose the pins. In this way, the pins are guarded at all time against access to ensure good protection against electrical shock which may otherwise be caused by external contact with the pins.

The method of actuation of the socket 10 is thus to first insert the plug 190, then turn the plug and the receptacle 18 to align the plug pins with contacts 20, 22 and 24, and then to push the plug inwardly to effect contact between the plug pins and the contacts 20, 22, 24. The plug can simply be removed from the socket by direct withdrawal; the pin guard 28 maintaining covering of the pins during such action. After withdrawal, the receptacle 18 is automatically returned to its inactive, locked, condition by action of spring 120. The abutments 148 on tongue 142 are automatically entered back into openings 90, 94, under natural resilience thereof. Also, spring 78 moves the pin guard 36 back to its original position (FIG. 2).

It will be appreciated that, because of the presence of the two locking means 140, both of these are required to be actuated before the plug can be moved from its inactivated to its activated condition. When the plug is inserted into the socket, the simultaneous activation of both locking means is readily accomplished, as a matter of course, by the engagement of the two pins of the plug therewith. On the other hand, it is difficult to externally manipulate the socket to enable it to be bought from its inactive to its active condition by use of other than a specially formed too. For example, the pin receiving openings of the socket are of course too small to permit access to the locking means by insertion of fingers or the like therethrough, and readily available hand tools or similar such as screw-drivers or the like would permit access only to one of the openings at a time, unless two were used, requiring considerable manual dexterity. Thus, infants unaware of the hazards of tampering with electrical sockets would be unlikely to manipulate the socket to bring it from its inactive to its active condition.

Generally, it has not been found to necessary to provide a third locking means to co-operate with the earth pin, but such could be provided if desired. Furthermore, while as indicated it is preferable to provide at least two locking means, it would possible to provide an arrangement having only a single such locking means actuated by a single one of the pins of an electric plug.

We claim:

1. An electric power outlet socket comprising a structure supporting electrical contacts for connection to pins of an electric plug when inserted into the socket and a plug receptacle mounted for movement between a first position at which the contacts are covered to prevent access thereto and a second position at which the contacts are uncovered to permit making said connections thereto, and locking means normally preventing movement of the receptacle to the second position but being engagable by the pins of said plug when inserted into the receptacle to permit release thereof for permitting movement to said second position, wherein the receptacle further includes a pin guard, said pin guard having pin receiving openings therein and arranged to enclose the pins during movement of the plug to effect engagement between the pins and said contacts, said pin guard being mounted for movement with the plug whereby to enclose said pins during said plug movement, said plug receptacle being carried by said structure for rotational movement between said first and second positions, and including a contact guard positioned to cover said contacts in the first position of the receptacle, said pin guard being coupled to the contact guard for rotation therewith, and the pin guard being resiliently biased outwardly relative to the contact guard.

2. An electric power socket as claimed in claim 1, wherein the contact guard has openings aligned with the openings in said pin guard for passage therethrough of said pins of said plug to make connection with said contacts, said locking means including resilient tongues formed on a surface of said structure which is opposed to an overlying transverse surface of the contact guard, said tongues having upstanding abutments which in said first position of the plug receptacle are engaged in the openings in the contact guard to prevent rotation of the contact guard, said tongues being, however, resiliently depressible by engagement with ends of said pins when said plug is moved inwardly of the socket to depress the tongues to release the locking means and to permit said rotation.

3. An electrical power outlet socket as claimed in claim 2, wherein the said pin guard is of hollow cylindrical form with an outer transverse wall and a tubular section which extends rearwardly therefrom, said contact guard being of a disc-like configuration slideably retained within said tubular section.

4. An electric power socket as claimed in claim 3, wherein the inner surface of said tubular section and the outer surface of said contact guard have co-operating elements of a slideable coupling for preventing rotation of the pin guard relative to the contact guard.

5. An electric power outlet socket as claimed in any one of claims 1, 2, 3 and 4 wherein resilient means is provided biasing said plug receptacle to said first position, for returning the plug receptacle to said first position on removal of a plug from engagement with the socket.

* * * * *